United States Patent [19]

Maly et al.

[11] 3,972,198

[45] Aug. 3, 1976

[54] METHOD OF PROTECTING A PILE IMBEDDED IN OFFSHORE AREAS HAVING A SHIFTING LAYER OF MUD

[75] Inventors: George P. Maly, Newport Beach, Calif.; Clifton A. Tannahill, Houston, Tex.

[73] Assignee: Union Oil Company of California, Brea, Calif.

[22] Filed: Sept. 12, 1975

[21] Appl. No.: 613,038

Related U.S. Application Data

[63] Continuation-in-part of Ser. No. 499,650, Aug. 22, 1974, Pat. No. 3,924,414.

[52] U.S. Cl. ..... 61/98; 61/50; 61/53.74

[51] Int. Cl.[2] ..... E02D 29/00

[58] Field of Search ..... 61/53.5, 53, 53.74, 61/53.68, 56, 58, 54, 46, 46.5, 50, 52; 175/67

[56] References Cited

UNITED STATES PATENTS

| | | | |
|---|---|---|---|
| 1,024,822 | 4/1912 | Bignell | 61/53.74 X |
| 1,529,113 | 3/1925 | Burns | 61/56 |
| 2,720,381 | 10/1955 | Quick | 175/67 X |
| 3,128,604 | 4/1964 | Sandberg | 61/46.5 |
| 3,289,421 | 12/1966 | Hindman | 175/67 X |
| 3,379,265 | 4/1968 | Geiger | 61/53.74 |
| 3,842,608 | 10/1974 | Turzillo | 61/53.74 X |

*Primary Examiner*—Dennis L. Taylor

[57] ABSTRACT

A method for protecting a stationary rigid pile extending through a layer of mud susceptible to movement and imbedded in an underlying competent bottom from the forces which the mud can exert against the pile. Fluid is ejected outwardly from the interior of the pile through a plurality of orifices into the mud adjacent to the pile. The ejected fluid increases the fluid content of the adjacent mud and thereby reduces the forces which the mud can exert on the pile.

14 Claims, 6 Drawing Figures

METHOD OF PROTECTING A PILE IMBEDDED IN OFFSHORE AREAS HAVING A SHIFTING LAYER OF MUD

CROSS-REFERENCES TO RELATED APPLICATIONS

This is a continuation-in-part of application Ser. No. 499,650 filed Aug. 22, 1974, now U.S. Pat. No. 3,924,414.

BACKGROUND OF THE INVENTION

This invention relates to piles used in offshore areas, and more particularly to a method of protecting piles used in areas having a mud layer susceptible to movement from the forces that the mud can exert against the pile.

In some parts of the world, conditions exist which cause great masses of mud to be deposited on the ocean floor. Principally, these deposits are the result of silt, organic matter and other earthen material being deposited at the mouths of large rivers, such as the Mississippi River. Due to the slope of the ocean floor and the continual deposition of new mud, these large masses of mud are unstable, resulting in continual shifting or moving of the mud or intermittent mud slides triggered by storms or other disturbances.

In some areas off the Gulf Coast of the United States, where large oil and gas deposits exist, the mud may be as much as 200 feet thick. These hydrocarbon deposits are conventionally developed from fixed drilling and production platforms supported upon piles extending through the incompetent mud layer and imbedded into the underlying competent bottom. The movement of this mud results in large forces being exerted on these piles; and, in fact, pile-supported structures in the Mississippi River Delta have toppled, apparently the result of mud slides.

Thus, while a need exists for a method for protecting piles from the forces produced by the movement of mud along the ocean floor, and the bottom of other water bodies, no satisfactory method for protecting these piles or for reducing these forces has heretofore been proposed.

Accordingly, a principal object of this invention is to provide a method for protecting a pile used in offshore areas having a layer of mud susceptible to movement overlaying a competent bottom from the forces that the mud can exert against the pile.

Yet another object of this invention is to provide a method for reducing the forces exerted by mud moving against a pile extending through the mud and imbedded in the underlying competent bottom.

A further object of this invention is to provide a method for increasing the fluid content of the mud adjacent to a pile extending through the mud and imbedded in the underlying competent bottom.

Other objects and advantages of this invention will be apparent to those skilled in the art from the following description.

SUMMARY OF THE INVENTION

Briefly, this invention relates to a method for protecting a stationary rigid pile extending through a layer of mud susceptible to movement and imbedded in an underlying competent bottom from the forces that a moving layer of mud can exert against the pile, and to a method for reducing the forces that a moving layer of mud is exerting against the pile. A pile useful in the practice of this invention is a tubular member provided with apertures strategically located so that they will be above the competent bottom and within the mud layer when the pile is imbedded in the competent bottom and extends upwardly through the mud. The pile is also provided with means for supplying pressurized fluid to the apertures.

The method of this invention involves ejecting fluid from the interior of the pile, the fluid being ejected above said competent bottom and substantially exclusively into the mud adjacent to the pile. The fluid will be ejected at a volumetric rate sufficient to adequately increase the fluid content of the mud, i.e., fluidize the mud, thereby increasing the lubricity of the mud and reducing the abrasiveness, cohesiveness and shear stress of the mud adjacent to the pile, with a resulting reduction in the forces that the moving layer of mud can exert against the pile.

BRIEF DESCRIPTION OF THE DRAWINGS

The invention will be more readily understood by reference to the accompanying drawings, wherein like parts are identified by like numerals throughout, and in which.

DETAILED DESCRIPTION

Figure 1:
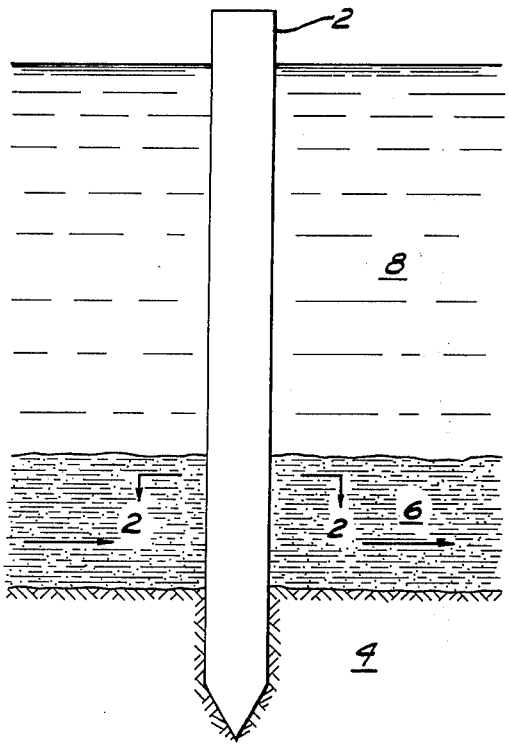
FIG. 1 is a vertical cross-sectional view of a water body having a moving layer of mud overlaying a competent bottom and schematically illustrates the installation of a conventional pile in this environment.

FIG. 1 illustrates the installation of a conventional tubular pile in an offshore area covered by water body 8 having moving layer of mud 6 overlaying competent bottom 4. Tubular pile 2 is driven through mud 6 and firmly imbedded in competent bottom 4. Although pile 2 is shown extending above the surface of water body 8, it need not do so; and, optionally, pile 2 can terminate below the surface of the water.

Figure 2:
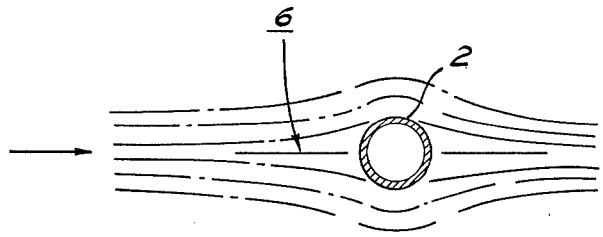
FIG. 2 is a horizontal cross-sectional view, taken along the line 2—2 of FIG. 1, schematically illustrating the movement of mud against and around the pile.

The mud is more dense than water and therefore settles in a dense layer at the bottom of the water body. The mud layer is incompetent in that it shifts or moves either continuously or intermittently in response to disturbances, such as those created by storms, currents, tidal flows, passing ships, detonations, and the like. FIG. 2 illustrates the flow of mud 6 along the path indicated by the arrow so that it impinges against and flows around pile 2. While in some areas the mud will move along generally similar paths, in other areas the magnitude and direction of the mud's movement can vary. Because of the thickness of the mud layer, which can be 200 feet or more, and the large areal extent of the mud layer, large masses of mud are involved. Since the mud is abrasive and, because of its low lubricity exhibits a high shear stress, extremely large forces can be exerted against the pile by the moving mass of mud. These large forces require that the pile be designed and constructed to withstand the forces exerted against it, thus increaing the cost of such piles. Worse yet, even with these precautions, pile-supported structures in mud slide areas have been known to fail.

Figure 3:
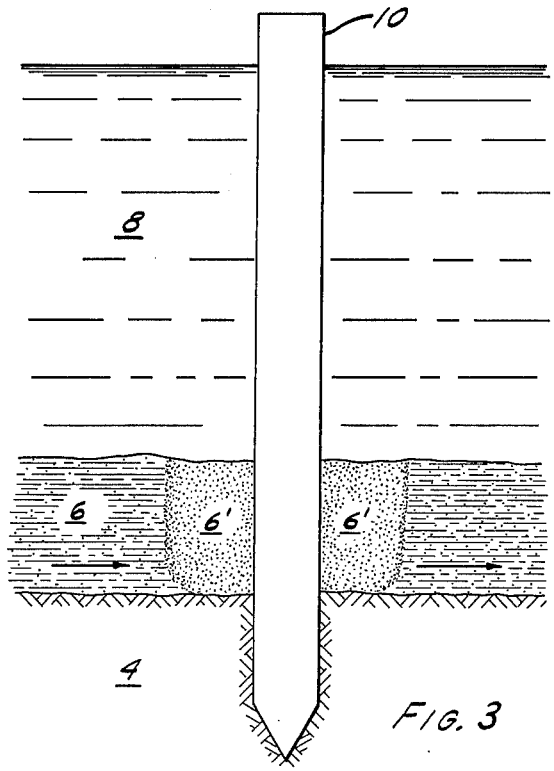
FIG. 3 is a vertical cross-sectional view of a water body having a moving layer of mud overlaying a competent bottom and schematically illustrates the practice of the method of this invention.

The method of protecting a pile in accordance with this invention in an offshore area having a moving layer of mud overlaying a competent bottom is illustrated in FIG. 3. As in the case of the conventional installation, pile 10 is driven through mud layer 6 and imbedded in underlying competent bottom 4 so as to extend upwardly through the mud layer. Pile 10 can terminate either above or below the surface of water body 8. Fluid at an elevated pressure is ejected from the interior of the pile, said fluid being ejected above said competent bottom and into the mud layer so as to fluidize the mud in zone 6' immediately surrounding pile 10 to reduce the density, abrasiveness, cohesiveness, and shear stress of the mud contacting the pile, and thereby reduce the forces exerted on the pile by the moving layer of mud. It is preferred that the fluid be ejected either exclusively or substantially exclusively into the mud layer. What is meant by ejecting fluid "substantially exclusively" into the mud is that while some fluid may be ejected into the water above the mud layer, it is the intent of the invention to eject the fluid only into the mud where it will be effective in protecting the pile. The pile protected by the method of this invention is subjected to substantially reduced forces, and thus, is less subject to structural failure or toppling than another pile under similar conditions but without the protection of this invention.

In areas which experience frequent and substantial mud movement, it is preferred to continually eject fluid from the pile, both before and during any movement of the mud layer. The continual ejection of fluid can be performed either by continuous ejecting fluid from the pile, or by ejecting fluid intermittently, such s for 10 minutes every hour. By ejecting the fluid at a sufficient volumetric rate, this embodiment of the invention will produce a blanket of mud having an increased fluid content and thereby provide certain and continuous protection against the forces of a moving layer of mud.

In areas which experience only infrequent and small movements of mud, it may be preferred to eject fluid from the pile only occasionally, such as one hour every day to ensure that the mud adjacent to the pile is adequately fluidized to protect the pile. Fluid ejection may also be resumed whenever it is determined that the previously ejected fluid has dissipated into the outer surrounding mud and now inadequately protects the pile, or when the fluidized mud adjacent to the pile has been displaced by a movement of the mud layer.

In areas which experience infrequent but larger movements of mud, rather than continually ejecting fluid from the pile, it may be preferred to only eject fluid into the mud while it is moving. This embodiment of the invention would be performed by first determining when the mud begins to move and then begin the ejection of fluid. The movement of mud can be determined by the placement of pressure sensitive devices on the exterior surface of the pile within the mud layer which would indicate any significant movement of the mud against the pile.

Figures 4, 5, 6:
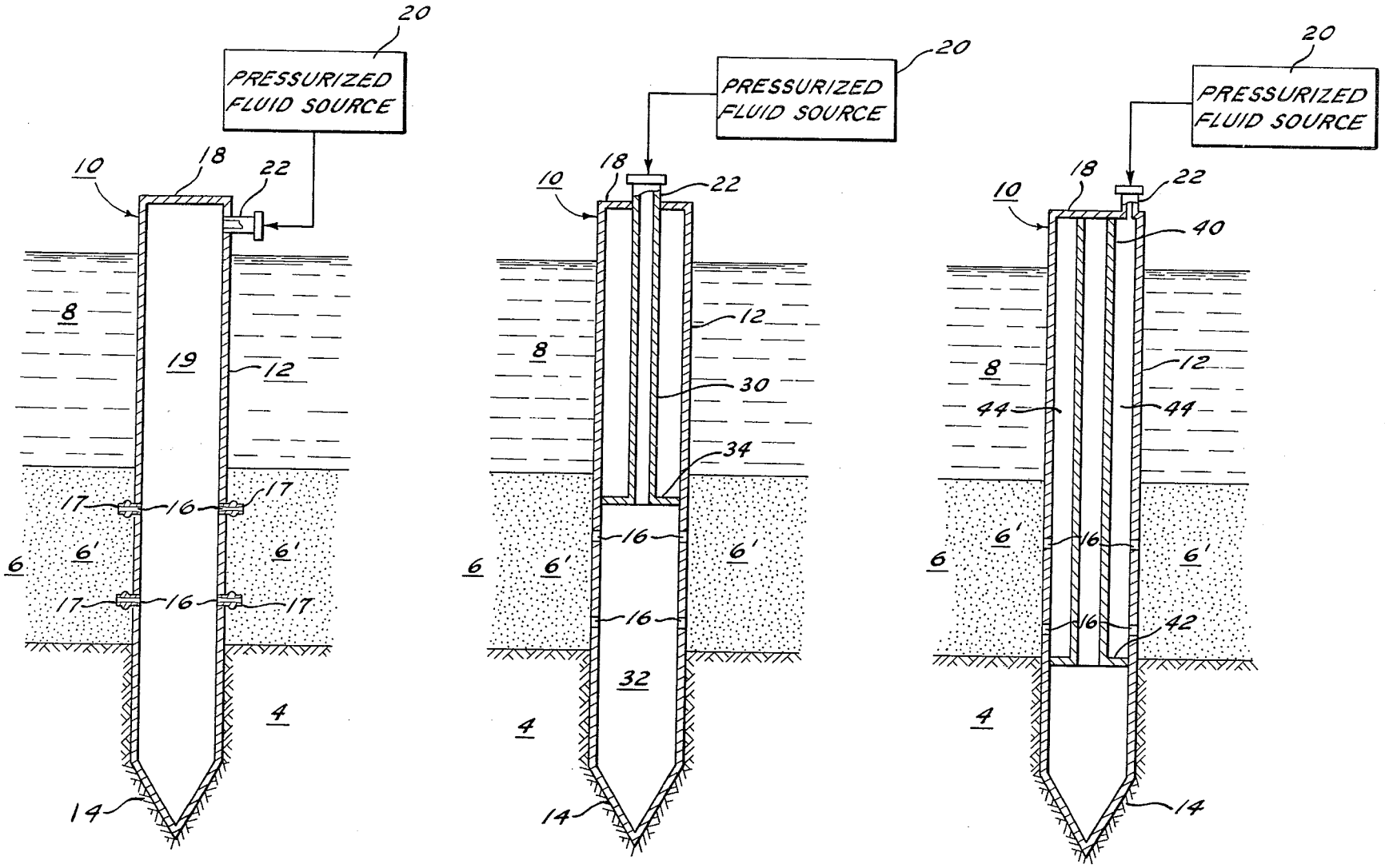
FIG. 4 is a vertical cross-sectional view of one embodiment of a pile useful in the practice of this invention, installed in a water body having a moving layer of mud overlaying a competent bottom.
FIG. 5 is a vertical cross-sectional view illustrating another means of practicing the method of this invention using a pile having an internally disposed, separate fluid supply conduit.
FIG. 6 is a vertical cross-sectional view illustrating still another means of practicing this invention, with a pile having an annular fluid supply conduit.

FIG. 4 illustrates one preferred embodiment of a pile useful in the practice of this invention. Pile 10 is comprised of elongated tubular member 12 having tip 14 to facilitate its being driven through mud 6 and into underlying competent bottom 4. Pile 10 can alternatively be open-ended, with an internal baffle plate located below apertures 16 and so positioned that it would be located above the competent bottom when the pile is permanently imbedded. Vents would also be provided through the pile below the internal baffle plate so as to allow the escape of water and mud from within the pile as the pile is driven into the competent bottom. A plurality of apertures 16 in the wall of tubular member 12 communicating the interior of the tubular member with the exterior thereof are strategically located in that portion of the tubular member that will ultimately be within the mud layer when the pile is installed in an offshore area. Apertures 16 can be simple holes of any geometric configuration, such as circular holes. Also, the apertures through which the fluid is ejected can be provided with jet nozzles 17, as illustrated in FIG. 4. A preferred embodiment utilizes a jet nozzle mounted in a freely rotating ball socket, which produces greater turbulence, mud dispersion, and reduces clogging of the apertures; however, if a freely rotating jet nozzle is not used, it is preferred that the apertures direct the fluid in a substantially horizontal direction.

In this embodiment of the pile, the upper end of tubular member 12 is fluid-tightly sealed by means of a cover plate 18, which defines an interior 19 that is utilized to conduct pressurized fluid from fluid inlet 22 to apertures 16 for ejection into the mud layer. Fluid from pressurized fluid source 20 is introduced into interior 19 of tubular member 12 through fluid inlet connection 22, the fluid flowing downwardly through the interior of the tubular member and being ejected through apertures 16, which may be provided with jet nozzles 17, into the mud surrounding the pile to fluidize the mud in zone 6'.

Another embodiment of a pile useful in the practice of this invention, having a separate internal conduit and internal chamber, is shown in FIG. 5. Tubular member 12 is provided with smaller diameter tubular conduit 30 extending from fluid inlet connection 22 to chamber 32 formed by the wall of tubular member 12 and transverse bulkhead 34. Fluid from pressurized fluid source 20 is introduced at an elevated pressure through fluid inlet connection 22 and conducted downwardly through internal conduit 30 to chamber 32. The fluid introduced into chamber 32 is discharged through the plurality of apertures 16 in communication therewith to fluidize the mud in zone 6'.

FIG. 6 illustrates another embodiment of a pile useful in the practice of this invention, having an internal annular conduit to conduct the pressurized fluid within the pile. Tubular member 12 is provided with a coaxially mounted, smaller diameter tubular member 40 extending from fluid inlet connection 22 to a point below the apertures 16, where a ringlike bulkhead 42 is provided, in conjunction with cover plate 18, to fluid-tightly seal the space between conduit 40 and tubular member 12 to form the internal annular conduit 44. Internal annular conduit 44 also functions as a chamber to supply the apertures with fluid. Fluid introduced through fluid inlet connection 22 flows downwardly through internal annular conduit 44 and is discharged through apertures 16.

Since the direction of the mud movement cannot always be predicted, or known, it is preferred that the apertures 16 be distributed about the periphery of the pile; and it is even more preferred that the apertures be uniformly distributed about the periphery. The apertures 16 are located in an intermediate section of the pile that will be within the mud layer when the pile is installed in an offshore location. Thus, the longitudinal location of the apertures will depend upon the length of the pile, the expected depth of the mud layer, and the depth to which the pile will penetrate the underlying competent bottom.

Although the apertures can be uniformly distributed along an intermediate section of the pile within the mud layer, or distributed in some other convenient non-uniform arrangement, because the higher hydrostatic pressures at the greater depths result in larger forces being exerted against the pile, it is preferred to eject a larger proportion of the fluid into the lower portion of the mud layer. Thus, it is preferred that the apertures be sized to effect the ejection of the major portion of the fluid into the lower portion of the mud layer and to simultaneously eject the minor portion of the fluid into the upper portion of the mud layer; or alternatively, to employ a larger number of apertures within the lower portion of the mud layer to achieve the same effect.

A preferred system employs a plurality of apertures located in sets of four disposed uniformly about the periphery of the pile at each elevation. Each of the apertures would be spaced 90° apart about the periphery of the pile. The apertures at each successive elevation can be offset about the periphery, e.g., the apertures at each elevation can be offset 45° from those at the adjacent elevations.

Exemplary of one preferred arrangement of apertures employed in the piles useful in the practice of this invention is an arrangement in which the apertures in the bottom one-third of the section of the pile within the mud layer are spaced about 3 feet apart along the length of the pile, the apertures in the middle one-third of the section within the mud layer are spaced about 4 feet apart, and the apertures in the top one-third of the section within the mud layer are spaced about 6 feet apart. Four apertures located 90° apart are provided at each level, with the apertures at adjacent levels being offset 45°. The apertures are arranged so that the fluid is ejected horizontally away from the pile so as to produce maximum penetration of the fluid into the mud.

Although any of a wide variety of fluids can be employed to fluidize the mud adjacent to the pile, water and air are preferred because of their availability and low cost. The water can be obtained from the water body, with seal water being employed where the platform is installed in an offshore marine area. Under some conditions admixtures of water and air are preferred.

The fluid must be ejected through apertures 16 at a pressure sufficient to overcome the existing hydrostatic and hydrodynamic pressures at the aperture locations, and thus penetrate and fluidize the mud. The volumetric ejection rate of the fluid must be sufficient to increase the fluid content of the mud so as to create a blanket of fluidized mud around the pile; and if the volumetric ejection rate is high enough, the ejected fluid will create a substantially mud-free blanket of fluid around the pile.

Various embodiments and modifications of this invention have been described in the foregoing description, and further modifications will be apparent to those skilled in the art. Such modifications are included within the scope of this invention as defined by the following claims.

Having now described the invention, we claim:

1. A method for protecting a stationary rigid pile extending through a layer of mud susceptible to movement and imbedded in an underlying competent bottom from the forces that a moving layer of mud can exert against the pile, which comprises ejecting fluid outwardly from the interior of said pile, said fluid being ejected above said competent bottom and into said mud adjacent to said pile at a volumetric rate sufficient to reduce the forces that a moving layer of mud can exert against said pile.

2. The method defined in claim 1 wherein said fluid is water, air, or admixtures thereof.

3. The method defined in claim 1 wherein said fluid is ejected outwardly from a plurality of locations spaced around the periphery of said pile, all of said locations being located above the competent bottom and substantially exclusively within the mud layer.

4. The method defined in claim 1 wherein said fluid is ejected continuously.

5. The method defined in claim 1 wherein said fluid is ejected intermittently.

6. The metod defined in claim 1 wherein said fluid is ejected only after determining that said layer of mud is moving.

7. A method for protecting a stationary rigid pile extending through a layer of mud susceptible to movement and imbedded in an underlying competent bottom from the forces that a moving layer of mud can exert against the pile, which comprises supplying fluid at an elevated pressure to an internal chamber within said pile, and ejecting said fluid outwardly from said chamber into the mud adjacent to said pile from a plurality of locations spaced around the periphery of said pile at a volumetric rate sufficient to increase the fluid content of the mud adjacent to said pile, all of said locations being located above the competent bottom and substantially exclusively within the mud layer.

8. The method defined in claim 7 wherein the major portion of said fluid is ejected into the lower portion of said mud layer susceptible to movement and the minor portion of said fluid is simultaneously ejected into the upper portion of said mud layer.

9. A method for reducing the forces exerted by a moving layer of mud against a stationary rigid pile extending through the moving layer of mud and imbedded in an underlying competent bottom, which comprises ejecting fluid outwardly from the interior of said pile, said fluid being ejected above said competent bottom and substantially exclusively into said moving layer of mud at a volumetric rate sufficient to reduce the forces which said mud exerts against said pile.

10. A method for reducing the forces exerted by a moving layer of mud against a stationary rigid pile extending through the moving layer of mud and imbedded in an underlying competent bottom, which comprises supplying fluid at an elevated pressure to an internal chamber within said pile and ejecting said fluid outwardly from the chamber into the mud adjacent to said pile from a plurality of locations spaced around the periphery of said pile at a volumetric rate sufficient to reduce the forces which said moving layer of mud exerts against said pile, all of said locations being located above the competent bottom and substantially exclusively within the mud layer.

11. The method defined in claim 10 wherein the major portion of said fluid is ejected into the lower portion of said moving layer of mud and the minor portion of said fluid is simultaneously ejected into the upper portion of said moving layer of mud.

12. The method defined in claim 10 wherein said fluid is ejected continuously.

13. The method defined in claim 10 wherein said fluid is ejected intermittently.

14. The method defined in claim 10 wherein said fluid is ejected only after determining that said layer of mud is moving.

* * * * *